US006068167A

United States Patent [19]

Hopson

[11] Patent Number: 6,068,167

[45] Date of Patent: May 30, 2000

[54] SLING FOR A WEAPON

[76] Inventor: Cecil I. Hopson, 1880 Little Warrensburg Rd., Midway, Tenn. 37809

[21] Appl. No.: 09/152,298

[22] Filed: Sep. 14, 1998

[51] Int. Cl.[7] ..... F41C 23/02

[52] U.S. Cl. ..... 224/150; 224/257; 224/258; 224/913

[58] Field of Search ..... 224/150, 257, 224/258, 913

[56] References Cited

U.S. PATENT DOCUMENTS

| | | | |
|---|---|---|---|
| 1,186,496 | 6/1916 | Randall | 224/150 |
| 1,210,475 | 1/1917 | Hooper . | |
| 1,292,875 | 1/1919 | Randall . | |
| 3,595,451 | 7/1971 | Branby . | |
| 4,150,464 | 4/1979 | Tracy . | |
| 4,249,686 | 2/1981 | Morwood | 224/150 |
| 4,511,070 | 4/1985 | Hightower . | |
| 4,768,689 | 9/1988 | Davis | 224/150 |
| 5,067,267 | 11/1991 | Ives . | |
| 5,433,360 | 7/1995 | Rock | 224/258 |
| 5,810,219 | 9/1998 | Rosenfield | 224/150 |

*Primary Examiner*—Stephen P. Garbe

*Attorney, Agent, or Firm*—Malcolm G. Dunn

[57] ABSTRACT

A sling adapted for connection to a weapon having a muzzle end and a stock at the opposite end from the muzzle end and formed from a single elongated web folded upon itself and including a first terminal end to be connected at or adjacent the weapon muzzle end; a first guide arrangement to be connected to or adjacent the stock of the weapon, and a first loop formed in the web around the first guide arrangement at the opposite end of the sling from the first terminal end and defining therebetween a connecting inner leg; a second guide arrangement, and a second loop formed in the web around the second guide arrangement and spaced from the first terminal end and defining a middle leg and an outer leg of equal lengths in the web; a second terminal end located intermediate the length of the sling and a connecting arrangement to which the second terminal end is attached, the outer leg extending between and connecting the second loop to the second terminal end; and a third guide arrangement, and a third loop formed in the web around the third guide arrangement, the middle leg extending from and connecting the second loop to the third loop, and the third loop defining on the side of the third guide arrangement opposite the middle leg a fourth leg connecting the third loop to the first loop.

8 Claims, 7 Drawing Sheets

SLING FOR A WEAPON

CROSS-REFERENCE TO RELATED APPLICATION

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention is directed to a sling for a weapon having a muzzle end and a stock at the opposite end from the muzzle end, and more specifically to a sling for such weapon wherein the sling is formed from a single elongated web folded upon itself and by which the user, whether wearing cold or warm weather clothing and whether in conditions of combat, hunting or the like, may quickly and safely adjust the sling in preparation for different tactical or other modes of carry of the weapon.

Slings for use with hand-carriable weapons, such as rifles or shotguns, have been known and used for many years. They are used to relieve the user from the strain of carrying the weapon directly, whether the user is a hunter, or is in the military, law enforcement or the like. The sling enables the user to be free to carry other items, or to cross over obstacles, or to climb or to descend, and yet retain the weapon close to the person of the user for ready use, if necessary.

The sling of the present invention is formed from a single, elongated web, preferably from a synthetic woven webbing such as nylon having great tensile strength and being highly resistant against most weather conditions. Such webbing, as constructed from nylon material, enables the sling to be manually and readily slidable to different adjusted positions and yet it has sufficient frictional characteristics to enable the sling to be retained in whatever position to which it is manually adjusted.

The sling of the present invention also may be readily adjusted so that the rifle or shotgun may be safely carried, either muzzle down or up, either in front or behind the user, either to one side or the other of the user, all depending on the conditions confronting the user, or leaving the user's hands free to climb or descend, cross obstacles, or to use a side arm in the event of a malfunction of the weapon, or to carry other equipment, but in all events enabling the user to retain the weapon about his or her person and under the control of the user.

The following patents are directed to slings for weapons, such as rifles or shotguns, which have in common with the present invention the fact that they are each also constructed from a single, flexible, elongated strap formed from a woven webbing and folded upon itself in a particular manner, and attached at one end of the sling to or adjacent the stock of the weapon and attached at the other end of the sling to or adjacent the muzzle end of the weapon. These patents include Hooper, U.S. Pat. No. 1,210,475 (1917); Randall, U.S. Pat. No. 1,292,875 (1919); Branby, U.S. Pat. No. 3,595,451; and Hightower, U.S. Pat. No. 4,511,070 (1985). Each of them may be manually slidingly adjusted, while attached in the manner described to the rifle shotgun, to increase the overall length of the sling and thereby produce a loop to accommodate several modes of carry of the weapon by the user in the field, and conversely, may be manually slidingly adjusted to shorten the overall length of the sling, and without the use of buckles or tongues or prongs to penetrate the web of the sling. The manually slidable position is retained in whatever position to which it is adjusted until the user decides to change it in some manner. The Branby sling differs from the others and from the present invention in that the sling is provided with a keeper or lock member, which must first be released before any manual sliding adjustments may be made by the user to increase the effective length of the sling or to decrease such length. The Hooper and Randall slings each differ from the present invention in at least three respects. The illustrated middle leg of the sling in Hooper and Randall is prevented from being moved when the sling is extended in length or shortened in length because each middle leg terminates in a hook that is connected to the stock of the rifle by either a link or a swivel. Also, the slings in each of Hooper and Randall are reversed end for end from that shown in the present invention by the three legs of the sling being located at the stock end of the weapon in Hooper and Randall, whereas in the present invention the three legs of the sling are located at the muzzle end of the weapon. The latter situation also results in a different manner of adjustment of the sling from that of the present invention. Third, upon release of the hook in either of the Hooper or Randall patents, there is no interconnection of the hook with the inner leg of the sling, as is the situation with the present invention. The nature of the construction of the Hightower sling severely limits the modes of possible carry of the weapon because the sling cannot be expanded sufficiently even to carry the weapon in a backpack position, for example.

BRIEF SUMMARY OF THE INVENTION

The present invention, therefore, is directed to a sling for a weapon having a muzzle end and a stock at the opposite end from the muzzle end such as a rifle, shotgun or the like and formed from a single elongated web folded upon itself. The sling and adapted includes a first terminal end formed in the elongated web at one end of the sling for attachment to or adjacent the muzzle end of the weapon. A first guide arrangement is provided and adapted for attachment to or adjacent the stock of the weapon, and a first loop is formed in the elongated web around the first guide arrangement and at the opposite end of the sling from the first terminal end. A connecting inner leg is formed in the elongated web and extends between the first terminal end and the first loop.

A second guide arrangement is provided, and a second loop is formed in the elongated web around the second guide arrangement and is spaced on one side inwardly along the length of the sling from the first terminal end and is also spaced on the other side inwardly along the length of the sling from the first loop.

The second loop defines a middle leg and an outer leg formed in the elongated web, and the middle leg and the outer leg are equal in length. A second terminal end is formed in the elongated web and a connecting arrangement is provided to which the second terminal end is attached. The outer leg extends between and connects the second loop to the second terminal end.

A third guide arrangement is provided, and a third loop is formed in the elongated web around the third guide arrangement. The middle leg extends from and connects the second loop to the third loop, and the third loop defines on the side of the third guide arrangement opposite from the middle leg a fourth leg connecting the third loop to the first loop.

The connecting arrangement for the second terminal end of the elongated web is also connected to the third guide arrangement and the third guide arrangement is manually slidable toward the second loop along the middle leg of the sling to decrease the lengths of the middle leg and the outer leg and to increase the length of the fourth leg and thereby increase the cumulative length of the middle leg and the fourth leg extending between the first loop and the second loop. Conversely, the third guide arrangement is manually slidable toward the second loop along the fourth leg to increase the lengths of the middle leg and the outer leg and thereby decrease the cumulative length of the middle leg and the fourth leg extending between the first loop and the second loop.

The sling also includes a first buckle to one end of which the first terminal end of the elongated web is attached and to the other end of which is detachably connected the second guide arrangement around which the second loop is formed. The second guide arrangement upon being detached from the first buckle is then manually slidable along the inner leg of the sling toward the first loop to thereby lengthen the inner leg of the sling.

The sling further includes a second buckle slidably mounted on the inner leg of the sling and defining an adjustable stop member to limit the extent to which the second guide arrangement may be manually slid along the inner leg toward the first loop when the second guide arrangement is detached from the first buckle.

The sling may be readily adjusted to change the relative lengths of the middle leg and fourth leg of the sling and consequently the outer leg of the sling, or it may be adjusted to change the relative lengths of the inner leg and the fourth leg, or it may be adjusted to change the lengths of any combination of the legs mentioned. Upon any adjustment, the lengths of the middle and outer legs will be essentially equalized.

DETAILED DESCRIPTION OF THE INVENTION

Figure 1:
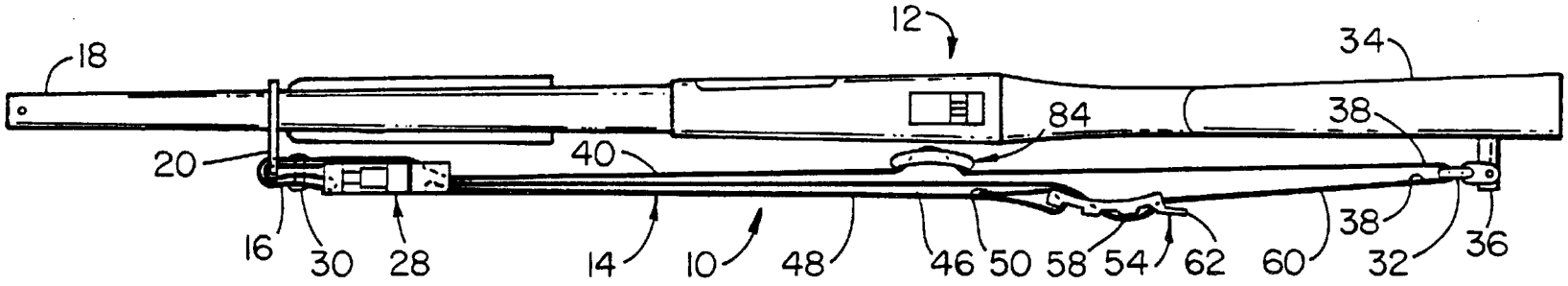
FIG. 1 is a plan view of the sling of the present invention, as mounted, for instance, on a weapon such as a shotgun as illustrated, showing the sling in closed or non-extended form.

In reference to FIGS. 1–16 of the drawings, the sling 10 of the present invention is shown as being adapted to be attached to a weapon 12, such as a rifle or shotgun. The sling 10 is formed from a single elongated web 14, which is folded upon itself in a particular manner, to be described herein, and is preferably constructed from a suitable material, such as a ballistic nylon known to have significant tensile strength and being highly resistant to rot, and most weather conditions including rain, snow and mud.

The sling 10 has a first terminal end 16 formed in the elongated web 14 at the end of the sling that is adapted to be attached to or adjacent the muzzle end 18 of the weapon 12, such as by a conventional swivel hook 20. As will be noted, for instance, with reference to FIG. 3, the elongated web adjacent the muzzle end of the weapon commences with the first end 22 (see FIG. 3) of the elongated web and from which the elongated web first extends to pass from outside to inside and around a transverse bar 24 of the swivel hook 20; second, to and around the inner side of the transverse bar 26 of a first buckle 28; and third, to and around again the transverse bar 24 of the swivel hook 22, thereby forming a double fold, and then extends beyond in a manner to be described later. The resulting double fold of the elongated web at the first terminal end 16 is then fastened intermediate of the double fold between the transverse bar 26 of the first buckle 28 and the transverse bar 24 of the swivel hook 22 by a "Chicago Screw" 30. which extends through all four layers of the first terminal end 16.

A first guide arrangement or ring member 32 may be adapted to be attached to or adjacent the stock 34 of the weapon 12, such as by a quick-detachable security type sling swivel 36, such as disclosed in U.S. Pat. No. 5,067,267 (1991) issued to Robert K. Ives. A first loop 38 is formed in the elongated web 14 around the first guide arrangement 32 at the opposite end of the sling from the location of the first terminal end 16 of the sling 10.

A connecting inner leg 40 is formed in the elongated web 14 and extends between the first terminal end 16 and the first loop 38 of the sling. The connecting inner leg 40 is positioned closest to the weapon 12 and lies in a non-extended position essentially parallel to a good portion of the length of the weapon 12.

Figure 5:
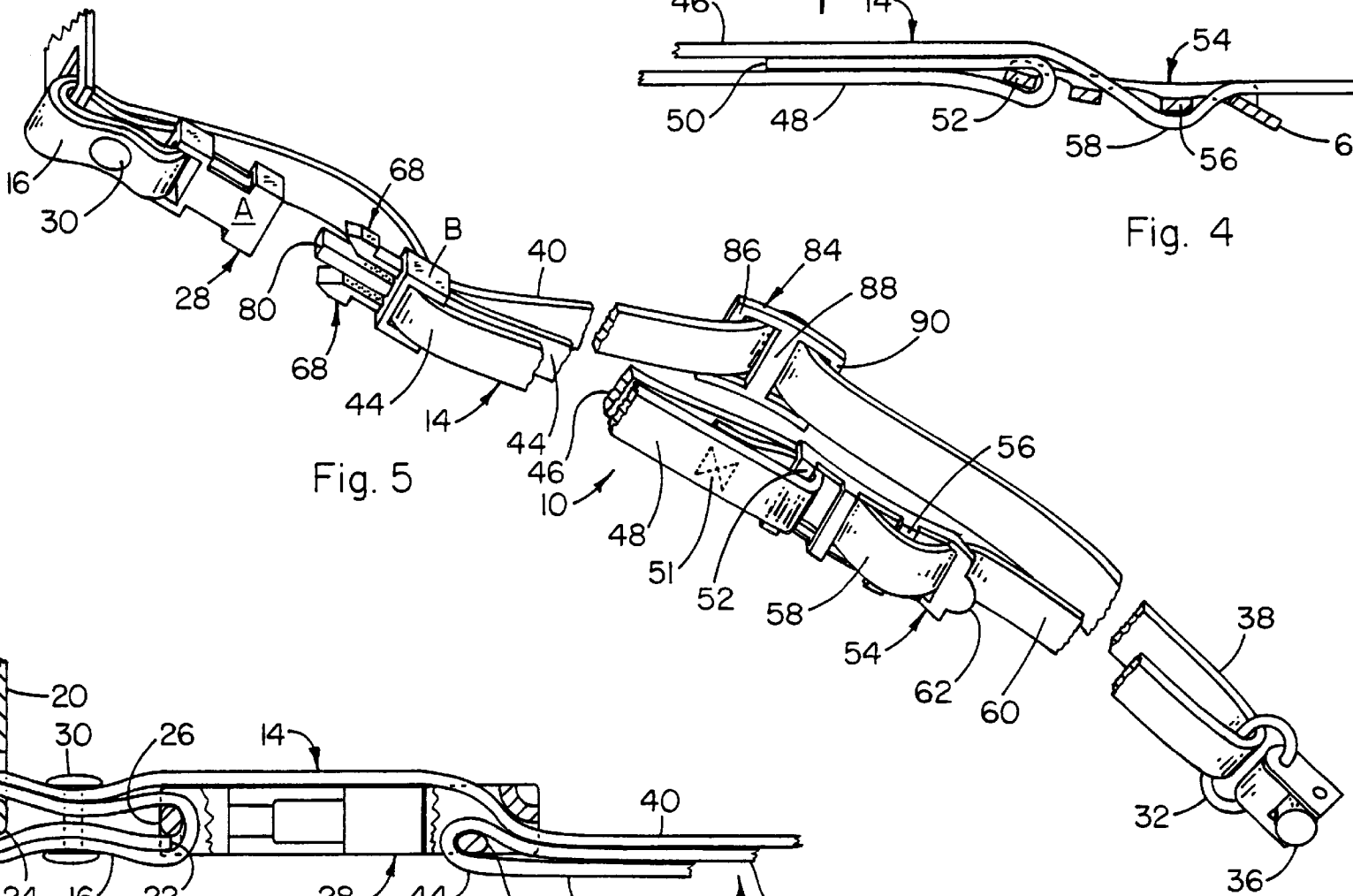
FIG. 5 is an enlarged isometric view of the sling partly broken away and illustrating details of the first buckle, the three bar buckle and the second buckle or adjustable stop member.
Figure 3:
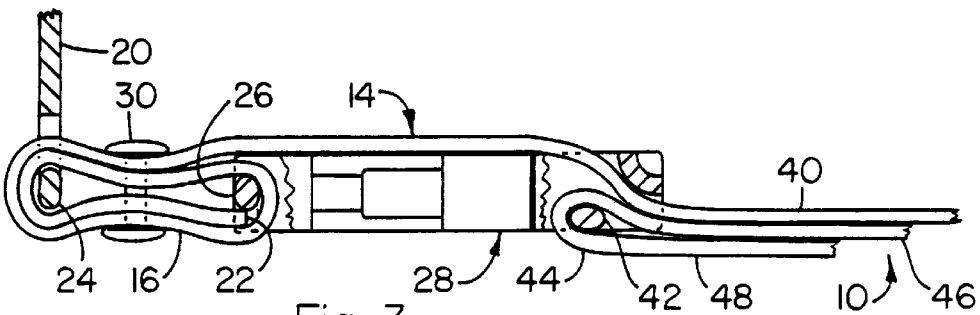
FIG. 3 is an enlarged plan view of a portion of the sling of the present invention illustrating details of the first terminal end and first buckle of the sling.

A second guide arrangement formed by a transverse bar 42 is detachably connected to the first buckle. 28, as illustrated in FIG. 5, and a second loop 44 is formed around the transverse bar 42 or the second guide arrangement. The second loop 44 is spaced on one side of the second loop inwardly along the length of the sling from the first terminal end 16, and is also spaced on the other side of the second loop inwardly along the length of the sling from the first loop 38.

The second loop 44 of the sling 10 defines a middle leg 46 and an outer leg 48 formed in the elongated web 14. The middle leg 46 and the outer leg 48 are essentially equal in length, and remain essentially equal following each adjustment (to be described later) of the sling.

A second terminal end 50 is formed at the opposite end of the elongated web 14 from the first terminal end 16 intermediate the length of the sling and may be stitched in the manner illustrated in FIG. 5 at 51 to the outer leg 48 of the sling. A connecting arrangement, as formed by transverse bar 52 of a three bar buckle 54, is provided to which attachment of the second terminal end 50 is made. The elongated web passes from the outside to the inside around the transverse bar 52 for connection at that location, as illustrated, for instance, in FIG. 5.

The outer leg 48 of the sling 10 extends between and connects the second loop 44 to the second terminal end 50 of the elongated web 14.

A third guide arrangement or transverse bar 56 is provided by the three bar buckle 54. A third loop 58 is formed in the elongated web 14 around the third guide arrangement or transverse bar 56. As will be noted from FIG. 5, for instance, the elongated web 14 passes from the inner side of the three bar buckle 54 to the outside, then around the transverse bar 56 to the inside of the transverse bar 56. The middle leg 46 of the sling 10 extends from and connects the second loop 44 to the third loop 58. The third loop 58 defines on the side of the third guide arrangement or transverse bar 56 a fourth leg 60, which connects the third loop 58 of the sling to the first loop 38 of the sling.

OPERATION OF SLING (TO THIS POINT IN DESCRIPTION)

In extending the length of the sling 10 to enable the user to carry the weapon in the various positions illustrated (in FIGS. 6–12, 15 and 16) of the drawings, the three bar buckle 54 is lifted at the "handle" or tip end 62 of the three bar buckle by the user. This lifting movement has the effect of easing the frictional engagement of the elongated web 14 with the third guide arrangement or transverse bar 56 so as to enable the third guide arrangement or transverse bar and the associated three bar buckle 54 to be manually slid toward the second loop 44 along whatever portion of the length of the middle leg 46 of the sling 10 thought necessary by the user to achieve the desired carry position of the weapon.

Figure 2:
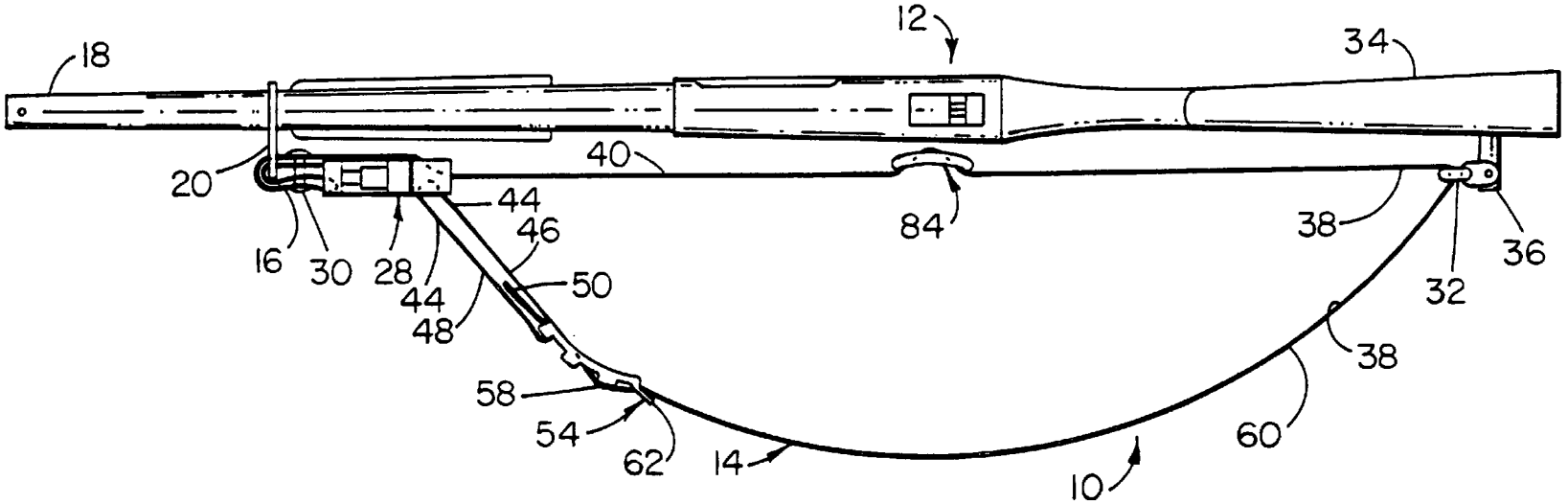
FIG. 2 is a view similar to that shown in FIG. 1, and illustrating the sling in open or extended form.
Figure 4:
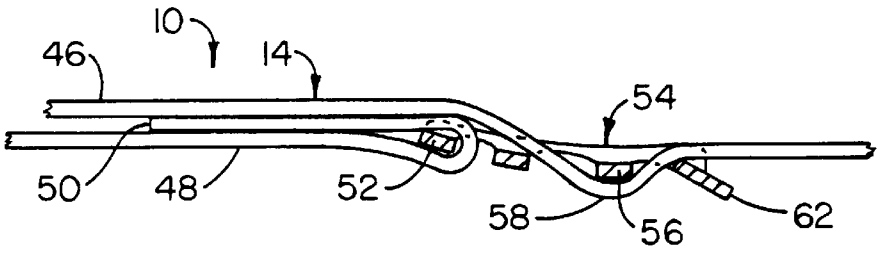
FIG. 4 is an enlarged plan view of a portion of the sling illustrating details of the second terminal end of the sling and the three bar buckle.

The initial effect of this manual sliding movement of the third guide arrangement or transverse bar 56 of the three bar buckle 54 results in the formation of slack in the outer leg or, in other words, the formation of a greater length in the outer leg than the length of the middle leg of the sling. The user then immediately, and automatically as a consequence, equalizes the length of both the outer leg and the middle leg of the sling when the user grasps the elongated web 14 at or near the location of the three bar buckle 54 and pulls outwardly at essentially right angles to the length of the sling and the weapon. FIG. 2 illustrates the middle leg and the outer leg in their new equalized lengths. This grasping and pulling movement causes the slack formed in the outer leg to travel around the transverse bar 26 of the first buckle 28 and thereby become part of the length of the middle leg 46, thereby also essentially equalizing the lengths of both the outer and middle legs. The end result is that the lengths of the middle leg and the outer leg of the sling are decreased and the length of the fourth leg is increased, thereby increasing the cumulative lengths of the middle leg, and of the fourth leg extending between the first loop 38 and the second loop 44, as shown in FIG. 2. The connecting inner leg 40, on the other hand, does not move and remains unaffected by the movement of the outer and middle legs of the sling, as also shown in FIG. 2. The connecting inner leg of the sling only moves when the user grasps all three legs, following which a portion of the length of the fourth leg 60 travels around the first guide arrangement or ring member 32 to become part of the length of the connecting inner leg. The connecting inner leg 40 does not move or change its position at the location of its engagement with the second guide arrangement or transverse bar 42 of the first buckle 28 around which the second loop 44 is formed.

When the user wishes to close the extended position of the sling 10 or, in other words, shorten the length of the sling, the user may grasp and hold the middle leg of the sling with one hand and slide the transverse bar 56 and its associated three bar buckle 54 in the direction of the first loop or, in other words, toward the stock 34 of the weapon 12. The movement initially creates slack in the middle leg 46 or, in other words, causes its length to be greater than that of the outer leg of the sling. The user again grasps and pulls at or near the three bar buckle, thus causing the slack in the middle leg to travel around the second guide arrangement or transverse bar 42 to become part of the length of the outer leg and thereby equalize the lengths of the middle and outer legs. Conversely, therefore, this has the end result of increasing the lengths of the middle leg and the outer leg, and to decrease the length of the fourth leg, thereby decreasing the cumulative length of the middle leg and the fourth leg extending between the first loop 38 and the second loop 44 in the sling 10. Again, these movements have no effect on the inner leg of the sling, unless the user happens to have grasped all three legs at the same time. Normally, however, the user has released the inner leg so that it remains in its usual unextended position essentially parallel with a significant portion of the length of the weapon.

In the extended length or open position of the sling 10 as shown in FIG. 2, for instance, the weapon 12 may be prepared by the user for different carry positions as described in more detail hereafter.

Figure 6:
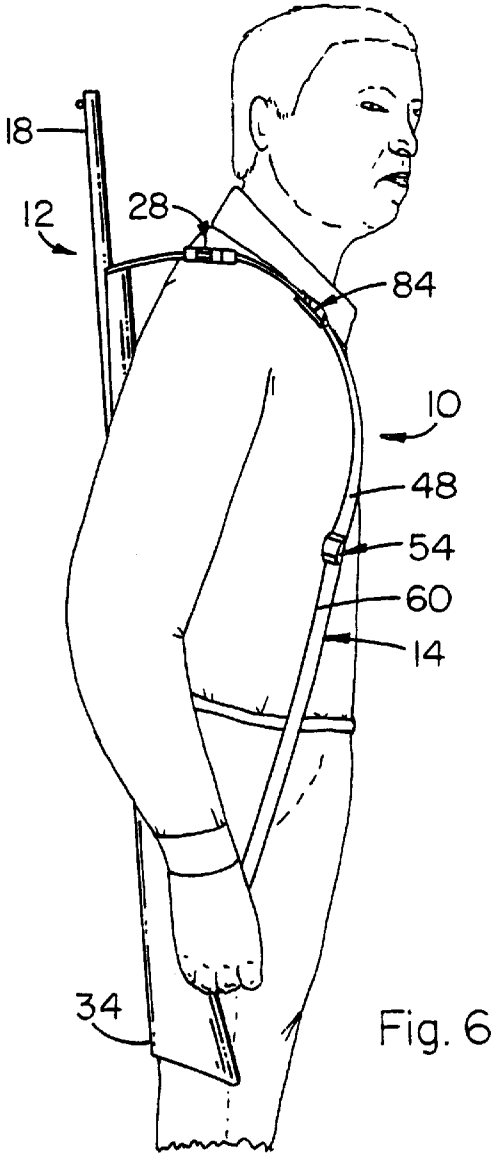
FIG. 6 is a view of the sling and the weapon when carried by the user in an "over one shoulder (right shoulder in this case for a right-handed user) carry" position with the muzzle end of the weapon pointing upward.
Figure 7:
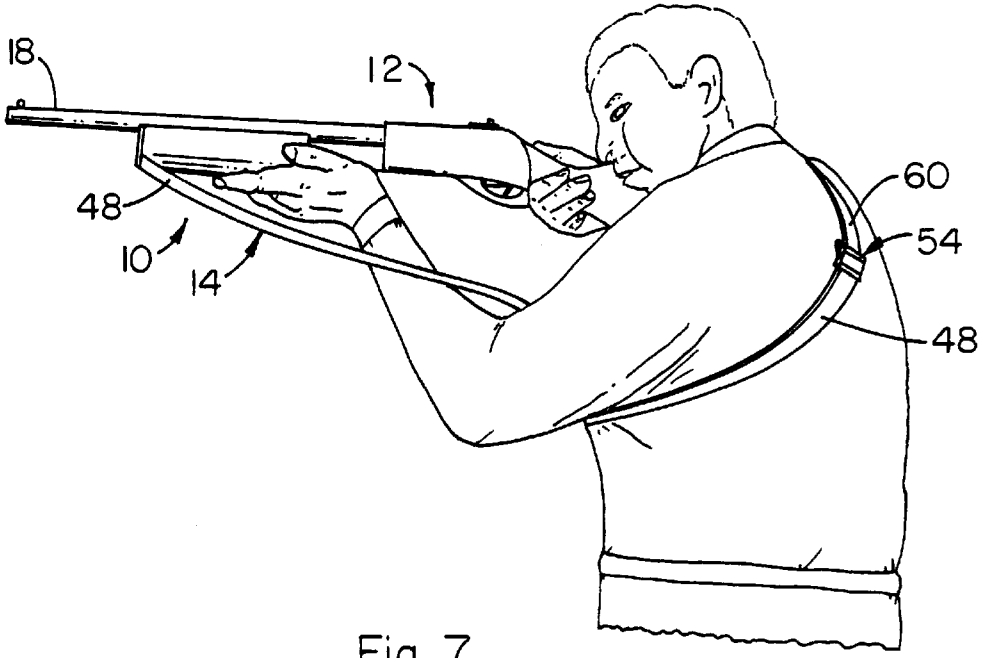
FIG. 7 is a view of the sling and the weapon when with the aid of the sling the weapon, in this case the illustrated shotgun, has been moved from the "over the shoulder carry" position as shown in FIG. 6, to the "standing ready firing position" by the user, the user in the course of making the transition from that shown in FIG. 6 has insinuated his left arm under and through the sling so that part of the sling now rests against the outside of the forearm of the user and then the user is now grasping and supporting the underside of the weapon while the sling now extends from the rear of the weapon where the sling is attached to the right shoulder of the user and then under the left arm of the user in return to the forepart of the weapon where the sling is attached.

With reference to FIG. 6, the user has only opened or extended the length of the sling sufficient so that the weapon may be carried in an "over one shoulder carry" position (the right shoulder is used for a right-handed user). From this position, the user may quickly transfer the weapon to a firing position, as shown in FIG. 7. The user may, for instance, grasp the forepart of the weapon with his left hand and at the same time engage a portion of the sling with his right thumb so that by a combination of both movements the user is able to bring the barrel of the weapon into a supported position with and by his left hand and the stock of the weapon has been moved into position against the front part of the shoulder of the user in preparation for firing, as shown in FIG. 7. As a carry position, however, the position shown in FIG. 6 is one of the least secure positions when walking or moving over rough ground and climbing over obstacles. The weapon may accidently slip off the shoulder unless the user makes a special and conscious effort to hold and maintain the weapon over his shoulder.

Figure 8:
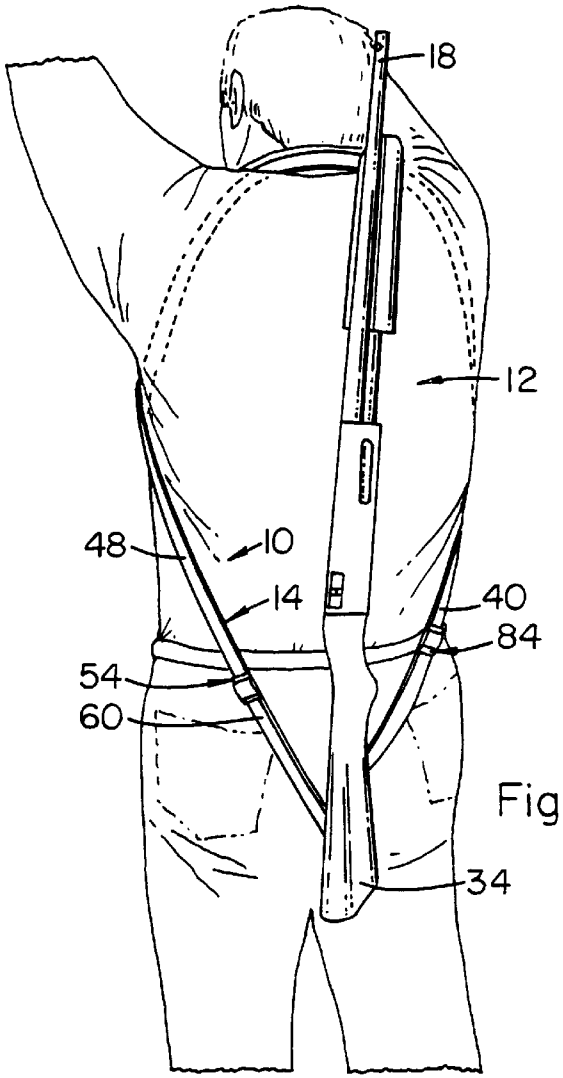
FIG. 8 is a view of the sling and the weapon shown in a "backpack carry" position with the muzzle end of the weapon pointing upwards and the stock of the weapon located in the vicinity of the seat of the user, thereby leaving the user's hands free to climb or to carry other equipment, as the need may arise, and illustrating the "spread" of the inner and outer legs of the sling to enable the inner leg extending from its connection to the stock of the weapon, and in this situation, to pass around the left side of the user and under the user's left arm and up to around the left side of the user's neck to the location of the attachment to the forepart of the weapon; while the outer leg passes around the right side of the user and under the user's right arm and up to around the right side of the user's neck to the location of the attachment to the forepart of the weapon.
Figure 9:
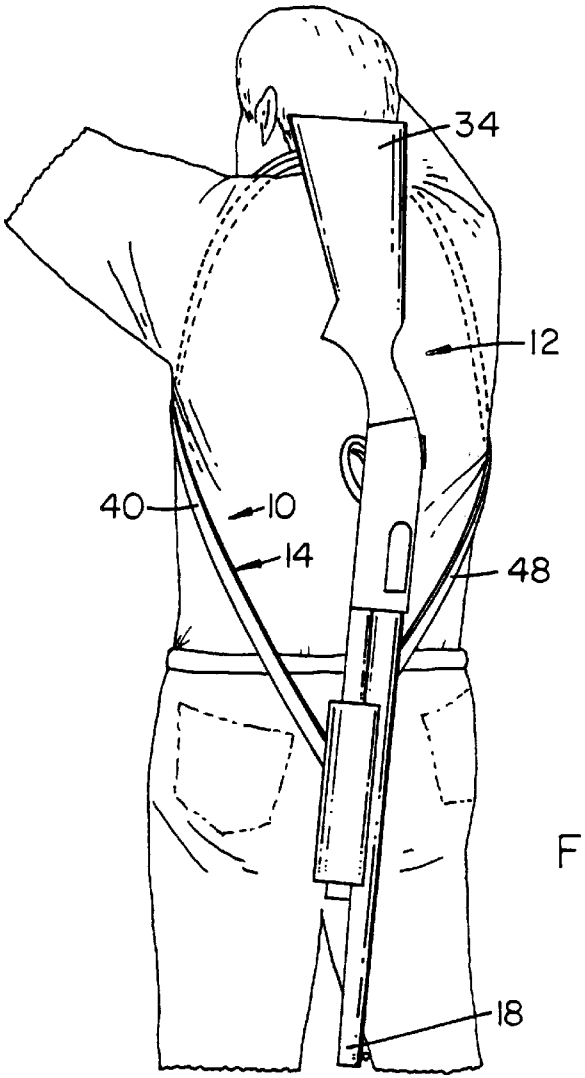
FIG. 9 is a view similar to the view shown in FIG. 8 except that the weapon has been reversed so that the muzzle end points downwardly to prevent rain or debris from entering the muzzle end opening.
Figure 10:
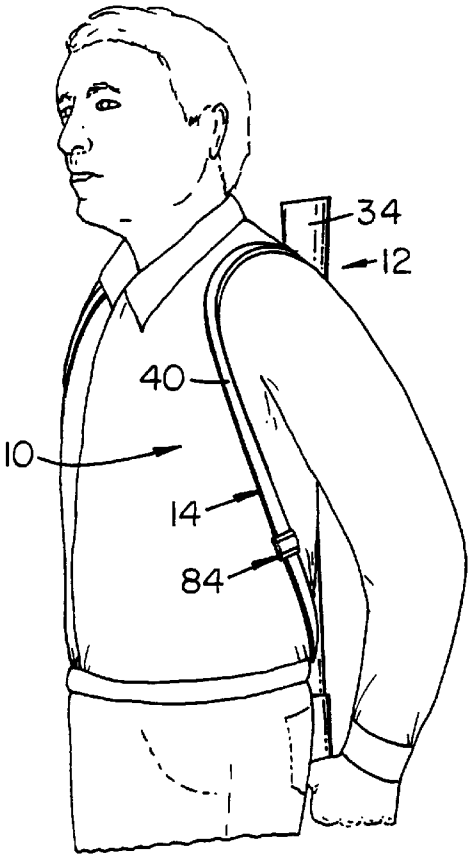
FIG. 10 is a frontal view of the user from the view shown in FIG. 9 and illustrating in part the spread of the inner and outer legs of the sling to allow them to extend in one direction under the respective arms of the user in return to the forepart of the weapon where one end of the sling is attached and to extend in the other direction over the respective shoulders of the user in return to the stock of the weapon where the other end of the sling is attached.

With reference to FIG. 8, the user has significantly opened or extended the length of the sling so that the weapon may be carried in a "backpack carry" position with the muzzle of the weapon pointing upwards and the stock of the weapon located in the general vicinity of the seat of the user. This position is one of the more secure positions for carrying a weapon because it will not accidently become dislodged from the user. This position also leaves the user's hands free to climb or carry other equipment as the need may arise. In this position of the sling, the connecting inner leg and the outer and middle legs as a unit, have been "spread" so as to enable the inner leg to extend from its connection to the stock of the weapon, pass around the left side of the user and under the user's left arm and up to and around the left side of the user's neck to the location of its attachment to the forepart or muzzle end of the weapon; while at the same time, the outer leg and middle leg as a unit pass around the right side of the user and under the user's right arm and up to and around the right side of the user's neck to the location of the attachment to the forepart or muzzle end of the weapon. In the event of rain, the weapon in the "backpack carry" position shown in FIG. 8 may be reversed, as shown in FIG. 9, so that the muzzle end of the weapon may be pointed downwardly to prevent water or debris from entering the opening in the muzzle end of the weapon. FIG. 10 shows the front view of the user for the "backpack carry" position shown in FIG. 8, and illustrates the appearance of the "spread" of the inner leg, and the outer and middle legs as a unit, to show the locations where the sling engages the user in this "backpack carry" position. A user would only use the positions shown in FIGS. 8–10 if there were no immediate need to bring the weapon into the firing position shown in FIG. 7.

Figure 11:
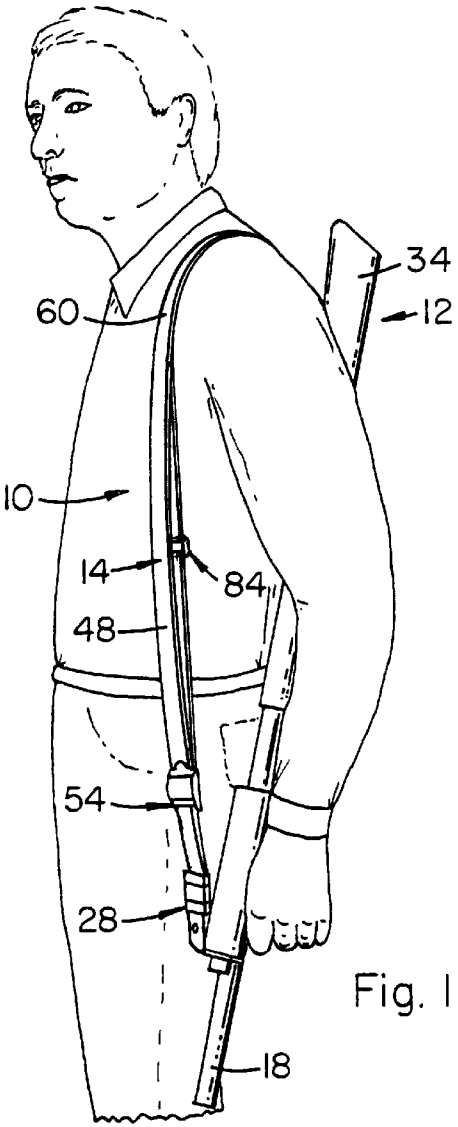
FIG. 11 is a view of the sling and the weapon as the user employs the "South African carry" position with the muzzle end of the weapon pointing downwardly in a non-offensive appearing position to the left side of the user (the user being right-handed) and the stock of the weapon being located at the back of the user, and illustrating the sling being supported and extending only over the left shoulder of the user and how the right-handed user employs his left hand in this mode of carry to grasp the forepart of the weapon in preparation for moving the weapon from under his left arm to a "standing ready firing position" as shown in FIG. 7 (a left-handed user would reverse the position to that of the right shoulder)

With reference to FIG. 11, this shows the user carrying the weapon in the "South African carry" position (as employed by a right-handed user) with the muzzle end of the weapon pointing downwardly in a non-offensive appearing position to the left side of the user and the stock of the weapon being located at the back of the user. In this position, the sling has been extended in length so that it extends over the left shoulder of the user. The user preferably employs his left hand in this type of carry to grasp the forepart of the weapon in preparation for moving the weapon from under his left arm to the "standing ready firing" position of FIG. 7. A left-handed user would reverse the positions to that of the right shoulder. The sling, in either position, continues to remain under control of the user, but from this position the weapon may be quickly transferred into the "standing ready firing" position shown in FIG. 7.

Figure 12:
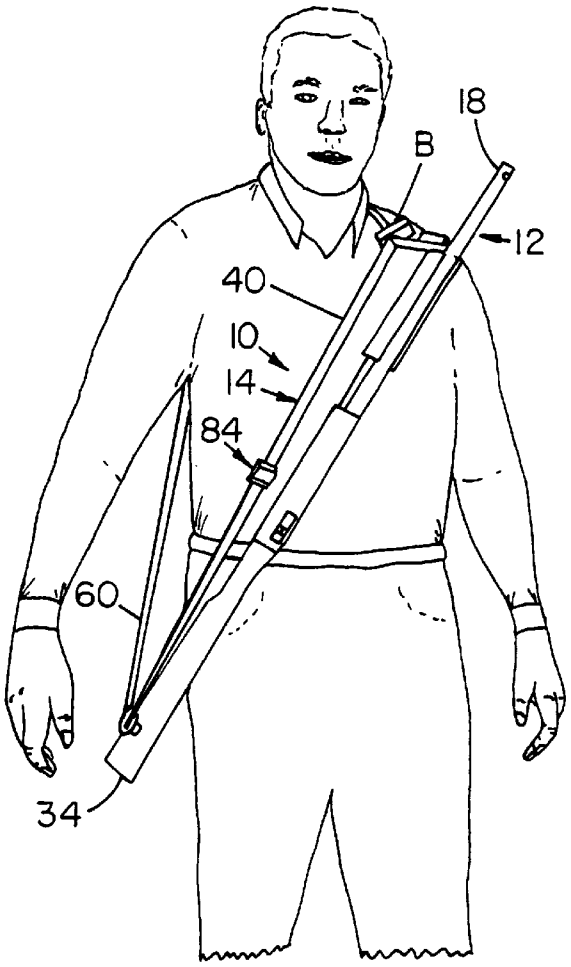
FIG. 12 shows the sling and the attached weapon in an "across the chest carry" position while leaving the hands of the user free to grasp a side arm, if necessary, and with the stock of the weapon being closely adjacent to be grasped by the right hand of the user (as for a right-handed user) and the muzzle end of the weapon resting against the left shoulder of the user in preparation to be grasped by the left hand of the user, if necessary, while the sling extends from its point of attachment at the stock of the weapon under the right arm of the user and up the back of the user and around the user's left shoulder to the point of connection of the sling at the forepart of the weapon while the inner leg of the sling extends from its point of connection at the stock of the weapon and across the chest of the user to the point of connection at the forepart of the weapon.

With reference to FIG. 12, the drawing shows the sling and the attached weapon in an "an across the chest carry" position, which is another position that leaves the hands of the user free to grasp a side arm, if necessary, or to do whatever needs to be done with the hands without releasing the weapon from the control and custody of the user. In this position, the stock of the weapon is shown as being closely adjacent to the right hand of the user (for a right-handed user), and that the muzzle end of the weapon rests against the left shoulder of the user in preparation to be grasped by the left hand of the user for moving the weapon into the "standing ready firing" position shown in FIG. 7. In this position (FIG. 12), the sling extends from its point of attachment at the stock of the weapon and under the right arm of the user and then up the back of the user and around the user's left shoulder to the point of connection of the sling at the forepart of the weapon. At the same time, the inner leg of the sling extends from its point of connection at the stock of the weapon and across the chest of the user to the point of connection at the forepart of the weapon.

SEPARABLE FIRST BUCKLE

Figure 13:
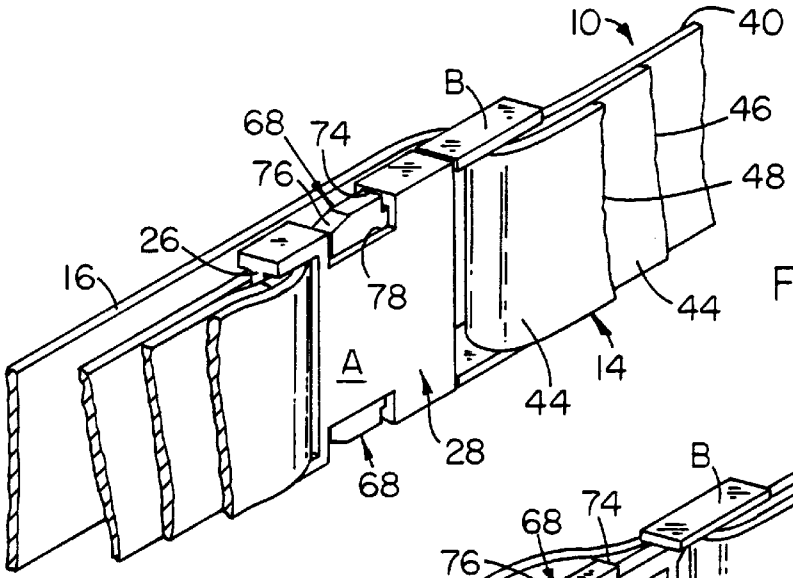
FIG. 13 is an enlarged view of a fractional portion of the sling broken away in parts and in cross-section illustrating the first buckle in a non-separated condition.
Figure 14:
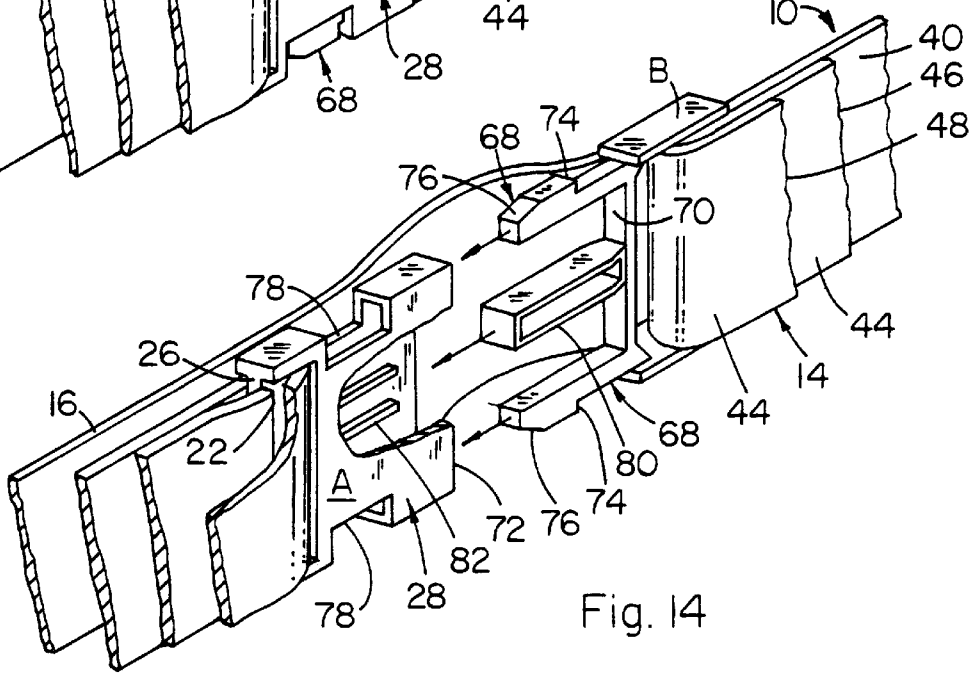
FIG. 14 is a view similar to that showing in FIG. 13, and illustrating the first buckle in a separated condition, partly broken away to illustrate the cooperating structure for the guide member of the first buckle.

In reference to FIGS. 13 and 14 and to the aforementioned first buckle 28, this buckle and the details of its construction and operation appear to be somewhat similar to that disclosed in U.S. Pat. No. 4,150,464 (1979) issued to Richard J. Tracy. This type of buckle is also well-known in the art and is often referred to as "a side release buckle," the meaning of which will become evident from the description that follows. The portion of the first buckle to which the first terminal end 16 is connected may be termed a "receptacle member" or "socket member" A, and the portion of the first buckle in which the second guide arrangement or transverse bar 42 is located may be termed a "clasp member" B. The receptacle or socket member and clasp member each include a cooperating coupling or locking arrangement.

The clasp member B includes a pair of resilient arms 68, which extend from a base portion 70. The resilient arms are spaced apart almost as wide as the extent of the end opening 72 in the receptacle or socket member A. Each of the resilient arms has formed at its leading edge a locking tab, such as a raised portion 74, which ends in a ramp 76. When the clasp member is inserted through the end opening 72 of the receptacle or socket member, the ramp 76 on each locking tab on one of the resilient arms engages the interior of the receptacle or socket member to cause each of the resilient arms 68 to be cammed inwardly toward each other. When cammed toward each other, both resilient arms may then be slid inwardly along the top and bottom walls of the receptacle or socket member until they reach the side opening through-slots 78, at which time the resilient arms spring back to their original position through the through-slots. In this manner the locking tabs or the raised portions 74 extend through the side opening through-slots 78 so as to prevent removal of the clasp member B from the receptacle or socket member A. A relatively rigid guide member 80 may also be located on the base portion 70 of the clasp member between the two resilient arms 68 to serve to center and guide the clasp member B as it is being inserted into the receptacle member or socket member A. Further cooperating structure 82 is provided within the receptacle member or socket member with which the relatively rigid guide member 80 engages when the clasp member is so inserted.

OPERATION OF SEPARABLE FIRST BUCKLE AND ADJUSTABLE STOP MEMBER

When the user wishes to separate the clasp member B from the receptacle member or socket member A, the user grasps with one hand each of the raised portions 74 or the locking tabs extending through the sides of the first buckle 28 or through-slots 78 of the receptacle member or socket member and presses inwardly on them to release the tabs from their locking engagement with the through-slots, while at the same time the user may perform a withdrawing movement on the clasp member B from the receptacle member or socket member A.

Since a portion of the connecting inner leg 40 and the outer leg 48 makes up the afore-described second loop 44 of the sling 10 and extends around the transverse bar 42 of the clasp member, which also constitutes the second guide arrangement for the second loop 44, the clasp member will remain interconnected at all times to the connecting inner leg of the sling, as will be noted from FIG. 5. The clasp member B, therefore, will be manually slid along the connecting inner leg of the sling toward the first loop 38 of the sling until the clasp member is prevented from further manual sliding movement by coming into abutment with the adjustable stop member 84. The adjustable stop member 84 is a buckle through which the inner leg of the sling is interthreaded or interconnected by first extending over one of the end transverse bars 86, then around the middle transverse bar 88, and finally over the other end transverse bar 90.

Figure 15:
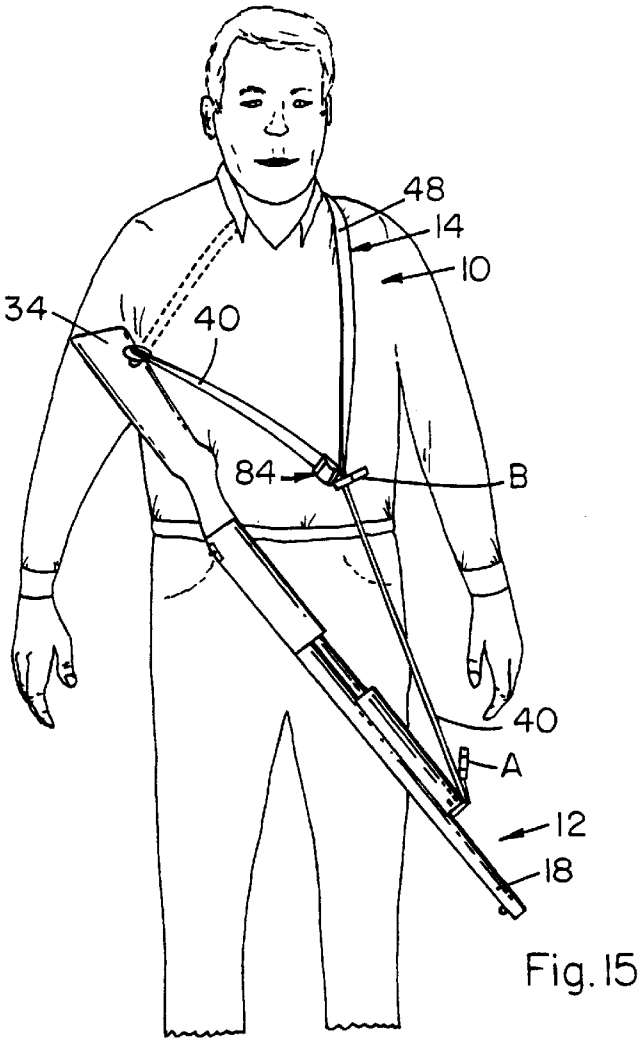
FIG. 15 shows the sling and the attached weapon supported by the sling in an extended length position of the sling across the front of the user thereby leaving the user's hands free and illustrating the second guide arrangement having been manually slid along the inner leg of the sling until prevented from further movement by abutment with the second buckle on the inner leg, with the second buckle serving as an adjustable stop member.
Figure 16:
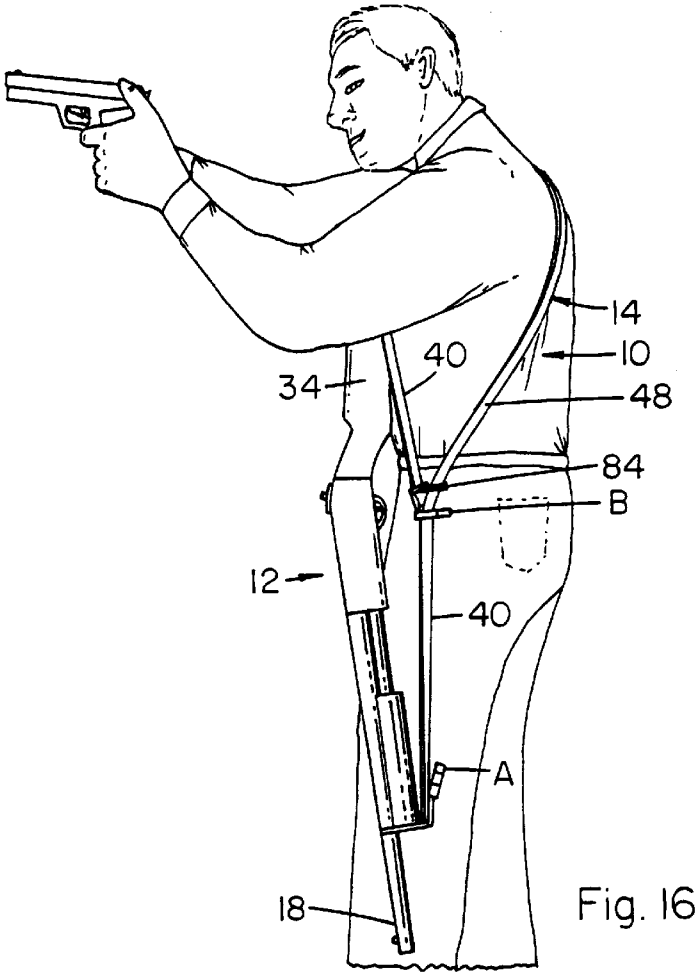
FIG. 16 shows the sling and the attached weapon supported by the sling in an extended length position of the sling similar to that shown in FIG. 15 and illustrating the weapon moved to the left side of the user (right-handed user) leaving the user's hands free to grasp and use a side arm, in the event of a malfunction of the sling-mounted weapon, while maintaining the sling-mounted weapon closely connected to the user.

By experiment, the user determines beforehand the positioning of the adjustable stop member 84, so that when he or she manually slides the released clasp member B of the first buckle 28 along the connecting inner leg 40 of the sling, the clasp member will always be stopped by the adjustable stop member 84 or second buckle at the preset position that has been found to be the most suitable to the user. This will enable the user to extend the sling, including the inner leg, to a greater length and thereby allow the user to carry the weapon in a more relaxed position, as shown in FIG. 15 and FIG. 16. In this position, there does not appear to be an immediate need for being prepared to move the weapon immediately into the "standing ready firing" position of FIG. 7, and yet the weapon will still remain within the control of the user. The user is free to use his or her hands for grasping a side arm or for anything else. The user should always maintain control of the weapon, even though the weapon may have misfired or otherwise has become defective for the time being, or possibly it is out of ammunition, or for any other reason. Also, the weapon is prevented from falling to the ground where it might be fouled by dirt or mud and water. The user may still bring the weapon into firing position with the increased length of the sling and connecting inner leg of the sling, if the weapon is still effective for a firing function. The user may also quickly shorten the sling from that extended length by sliding the clasp member B in the opposite direction toward the first buckle 28 along the inner leg 40 of the sling away from the adjustable stop member 84 until the clasp member B becomes housed again in the receptacle member or socket member A of the first buckle 28.

The invention has been described in detail with particular reference to preferred embodiments thereof, but it will be understood that variations and modifications can be effected within the spirit and scope of the invention.

I claim:

1. A sling (10) for a weapon (12) having a muzzle end and a stock at the opposite end from said muzzle end and formed from a single elongated web (14) folded upon itself, said sling comprising:

a) a first terminal end (16) formed in said elongated web at one end of said sling and adapted for attachment to or adjacent the muzzle end (18) of said weapon;

b) a first guide means (32) adapted for attachment to or adjacent the stock (34) of said weapon, and a first loop (38) formed in said elongated web around said first guide means and at the opposite end of said sling from said first terminal end;

c) a connecting inner leg (40) formed in said elongated web and extending between said first terminal end and said first loop;

d) A second guide means (42), and a second loop (44) formed in said elongated web around said second guide means and spaced on one side inwardly along the length of the sling from said first terminal end and also spaced on the other side inwardly along the length of the sling from said first loop;

e) said second loop defining a middle leg (46) and an outer leg (48) formed in said elongated web, said middle leg and said outer leg being equal in length; a second terminal end (50) formed in said elongated web and connecting means (52) to which said second terminal end is attached; said outer leg extending between and connecting said second loop to said second terminal end; and f) a third guide means (56), and a third loop (58) formed in said elongated web around said third guide means, said middle leg extending from and connecting said second loop to said third loop, and said third loop defining on the side of the third guide means opposite from said middle leg a fourth leg (60) connecting said third loop to said first loop.

2. A sling (10) for a weapon (12) and as defined in claim 1, wherein said connecting means (52) for said second terminal end (50) of said elongated web is also connected to said third guide means (56) and said third guide means is manually slidable toward said second loop (44) along said middle leg (46) to decrease the lengths of said middle leg and said outer leg (48) and to increase the length of said fourth leg (60) and thereby increase the cumulative length of said middle leg and said fourth leg extending between said first loop (38) and said second loop, and conversely said third guide means (56) is manually slidable toward said second loop along said fourth leg to increase the lengths of said middle leg and said outer leg and to decrease the length of said fourth leg and thereby decrease the cumulative length of said middle leg and said fourth leg extending between said first loop and said second loop.

3. A sling (10) for a weapon (12) and as defined in claim 1, and wherein said sling also includes a first buckle (28) comprising a receptacle member A connected to said first terminal end (16) of said elongated web (14) and a clasp member B separably attached to said receptacle member A and connected to said second guide means (42) around which said second loop (44) is formed, said second guide means upon said clasp member B being detached from said receptacle member A being manually slidable along said inner leg (40) of said sling toward said first loop (38) to thereby lengthen said inner leg.

4. A sling (10) for a weapon (12) and as defined in claim 3, and wherein said sling further includes a second buckle (84) slidably mounted on said inner leg (40) of said sling and defining an adjustable stop member to limit the extent to which said second guide means (42) may be manually slid along said inner leg toward said first loop (38) when said clasp member B is detached from said receptacle member A of said first buckle (28).

5. A sling (10) for a weapon (12) having a muzzle end and a stock at the opposite end from said muzzle end and formed from a single elongated web (14) folded upon itself and comprising:

a first terminal end (16) of the sling adapted for attachment at or adjacent the muzzle end (18) of the weapon;

a first guide means (32) defining a first loop (38) and adapted for attachment at or adjacent the stock (34) of the weapon and the sling defining between the first terminal end and the first guide means a connecting inner leg (40) of the sling;

a second guide means (42) defining a second loop (44) in the sling adjacent the first terminal end of the sling, and a third guide means (54) defining a third loop (58) in the sling intermediate the length of the sling, said second loop and said third loop forming therebetween a middle leg (46) of the sling;

a second terminal end (50) of the sling and connecting means (52) to which said second terminal end is attached, said second loop and said second terminal end forming therebetween an outer leg (48) of the sling;

said third loop and said first loop forming therebetween a fourth leg (60) of the sling; and said third guide means being interconnected on one side to and with said middle leg and on the other side to and with said fourth leg of the sling.

6. A sling (10) for a weapon (12) and as defined in claim 5, and wherein said third guide means (54) is manually slidably movable in either direction along the middle leg (46) and the fourth leg (60) of the sling to change the relative lengths of the middle leg and the fourth leg of the sling and consequently also the length of said outer leg (48) of the sling.

7. A sling (10) for a weapon (12) and as defined in claim 5, and wherein said sling comprises a first buckle (28) including a receptacle member A connected to said first terminal end (16) of the sling and a clasp member B separably attached to said receptacle member A and connected to said second guide means (42), and said second guide means is interconnected to and with said inner leg (40) of the sling and is separable along with said clasp member B from said receptacle member A of said first buckle for manual slidable movement along said inner leg to change the relative lengths of said inner leg and the fourth leg of the sling.

8. A sling (10) for a weapon (12) and as defined in claim 7, and wherein said sling comprises a second buckle (84) interconnected to and with said inner leg (40) of the sling and being manually slidably moveable along said inner leg and forms an adjustable stop member for limiting the slidable movement of said second guide means along said inner leg when said second guide means is manually slidable into abutment with said second buckle.

* * * * *